US011229986B2

(12) United States Patent
Aikawa

(10) Patent No.: US 11,229,986 B2
(45) Date of Patent: Jan. 25, 2022

(54) ANNULAR GRINDSTONE

(71) Applicant: DISCO CORPORATION, Tokyo (JP)
(72) Inventor: Hiroki Aikawa, Tokyo (JP)
(73) Assignee: DISCO CORPORATION, Tokyo (JP)

( * ) Notice: Subject to any disclaimer, the term of this patent is extended or adjusted under 35 U.S.C. 154(b) by 372 days.

(21) Appl. No.: 16/360,681
(22) Filed: Mar. 21, 2019

(65) Prior Publication Data

US 2019/0299366 A1 Oct. 3, 2019

(30) Foreign Application Priority Data

Mar. 29, 2018 (JP) ..... JP2018-065229

(51) Int. Cl.
*B24B 7/22* (2006.01)
*B24D 7/06* (2006.01)
*B26D 1/00* (2006.01)

(52) U.S. Cl.
CPC ..... *B24D 7/066* (2013.01); *B24B 7/22* (2013.01); *B26D 1/0006* (2013.01); *B26D 2001/0053* (2013.01)

(58) Field of Classification Search
CPC . B24D 7/066; B24D 5/12; B24D 3/06; B24D 18/0018; B24D 27/0683; B26D 1/0006; B26D 2001/0053; B24B 7/22; B24B 41/04
USPC ..... 451/41, 548; 51/309, 295
See application file for complete search history.

(56) References Cited

U.S. PATENT DOCUMENTS 6,306,274 B1 * 10/2001 Kajiyama ..... C25D 7/00 205/67
2004/0041121 A1 * 3/2004 Yoshida ..... H01F 41/0246 252/62
2009/0165768 A1 * 7/2009 Kasashima ..... B23D 61/028 125/15

FOREIGN PATENT DOCUMENTS

JP 08130201 A 5/1996
JP 11300184 A 11/1999
JP 200087282 A 3/2000
WO WO-02052054 A1 * 7/2002 ..... C23C 30/005

OTHER PUBLICATIONS

Tan, Li Rong, et al. "Electroplating Nickel-Iron Alloy on the Diamond Surface." Key Engineering Materials, vol. 416, Trans Tech Publications, Ltd., Sep. 2009, pp. 164-167. Crossref, doi:10.4028/www.scientific.net/kem.416.164. (Year: 2009).*

* cited by examiner

*Primary Examiner* — Joseph J Hail
*Assistant Examiner* — Arman Milanian
(74) *Attorney, Agent, or Firm* — Greer, Burns & Crain, Ltd.

(57) ABSTRACT

An annular grindstone includes a grindstone portion including a binding material, and abrasive grains which are dispersed into the binding material to be fixed, in which the binding material contains a nickel-iron alloy. Preferably, a contained ratio of iron in the nickel-iron alloy is in a range of 5 wt % or more to less than 60 wt %. More preferably, a contained ratio of iron in the nickel-iron alloy is in a range of 20 wt % or more to 50 wt % or less. Preferably, the annular grindstone includes the grindstone portion only. In addition, the annular grindstone further includes an annular base including a grip portion, in which the grindstone portion is exposed at an outer peripheral edge of the annular base.

8 Claims, 6 Drawing Sheets

ANNULAR GRINDSTONE

BACKGROUND OF THE INVENTION

Field of the Invention

The present invention relates to an annular grindstone mounted to a cutting apparatus.

Description of the Related Art

A device chip is, for example, formed by cutting a disc-shaped wafer containing a semiconductor. For example, a plurality of crossing division lines are set on a front surface of the wafer, and the wafer is demarcated into a plurality of regions by the plurality of division lines, whereby each of the regions thus demarcated by the division lines has a device containing the semiconductor, such an integrated circuit (IC), formed therein. Then, the wafer is divided along the division lines into individual device chips. Division of the wafer uses a cutting apparatus provided with an annular grindstone (cutting blade). In the cutting apparatus, the annular grindstone is made to cut in a workpiece while rotating in a plane perpendicular to the workpiece such as a wafer. The annular grindstone includes a grindstone portion containing abrasive grains and a binding material in which the abrasive grains are dispersed, and the abrasive grains which are moderately exposed from the binding material come in contact with the workpiece, thereby cutting the workpiece (see Japanese Patent Laid-Open No. 2000-87282, for example). Moreover, there has been known an annular grindstone, called a hub type, including an annular base and in which the grindstone portion is formed on an outer periphery side of the annular base.

The annular grindstone of hub type is, for example, formed by electrodepositing the grindstone portion to an outer peripheral edge of the annular base through electrolytic plating or the like methods. More specifically, the annular grindstone is, for example, formed by electrodepositing a binding material such as a nickel layer or the like in which abrasive grains such as diamond abrasive grains are dispersed to an aluminum base. Note that the annular grindstone formed by electrolytic plating is called an electrodeposited grindstone, or an electroformed grindstone. When the wafer is cut with the annular grindstone, static electricity occurs due to friction between the annular grindstone and the wafer, causing an electrostatic breakdown of a device due to the static electricity. In view of this, to remove the static electricity, a cutting apparatus has been known in which carbon dioxide is mixed into cutting water to be supplied to the annular grindstone and the wafer in cutting (see Japanese Patent Laid-Open No. H8-130201 and Japanese Patent Laid-Open No. H11-300184, for example).

SUMMARY OF THE INVENTION

When carbon dioxide is mixed into the cutting water to be supplied to the annular grindstone, the binding material such as the nickel layer contained in the annular grindstone is corroded by the cutting water containing carbon dioxide. As a result, this corrosion reduces strength of the annular grindstone.

It is therefore an object of the present invention to provide an annular grindstone in which corrosion of the binding material is less likely to occur even when cutting water in which carbon dioxide is mixed is supplied.

In accordance with an aspect of the present invention, there is provided an annular grindstone including a grindstone portion including a binding material, and abrasive grains which are dispersed into the binding material to be fixed, in which the binding material contains a nickel-iron alloy.

Preferably, a contained ratio of iron in the nickel-iron alloy is in a range of 5 wt % or more to less than 60 wt %. More preferably, a contained ratio of iron in the nickel-iron alloy is in a range of 20 wt % or more to 50 wt % or less.

In addition, preferably, the annular grindstone includes the grindstone portion only. Moreover, preferably, the annular grindstone further includes an annular base including a grip portion, in which the grindstone portion is exposed at an outer peripheral edge of the annular base.

The annular grindstone according to the aspect of the present invention includes a grindstone portion including a binding material, and abrasive grains which are dispersed into the binding material to be fixed. The binding material contains a nickel-iron alloy. When a wafer is cut by use of the annular grindstone, cutting water containing carbon dioxide is supplied to the annular grindstone and the wafer. However, the binding material containing the nickel-iron alloy is less likely to generate corrosion due to the cutting water containing carbon dioxide. Thus, according to the aspect of the present invention, even when the cutting water containing carbon dioxide is supplied, it is possible to provide the annular grindstone in which the binding material is less likely to be corroded.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1A:
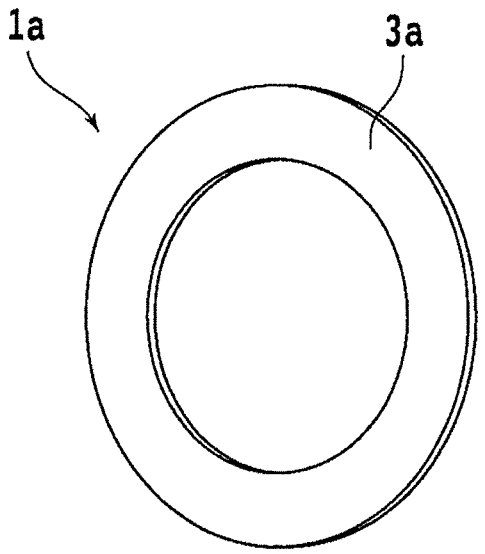
FIG. 1A is a perspective view schematically illustrating an annular grindstone including a grindstone portion.

An embodiment of the present invention will be described below. FIG. 1A is perspective view schematically illustrating an annular grindstone including a grindstone portion, as one example of an annular grindstone (cutting blade) according to the present embodiment. An annular grindstone 1*a* illustrated in FIG. 1A is a grindstone called a washer type. The annular grindstone 1*a* includes a grindstone portion 3*a* of a circular ring-shape having a through hole at a center thereof. The annular grindstone 1*a* is mounted on a cutting unit of a cutting apparatus. The through hole has a spindle passing therethrough, and by rotating the spindle, the annular grindstone 1*a* is rotated in a plane perpendicular to an extending direction of the through hole. Then, when the grindstone portion 3*a* of the rotating annular grindstone 1*a* is brought into contact with a workpiece, the workpiece is cut.

Figure 1B:
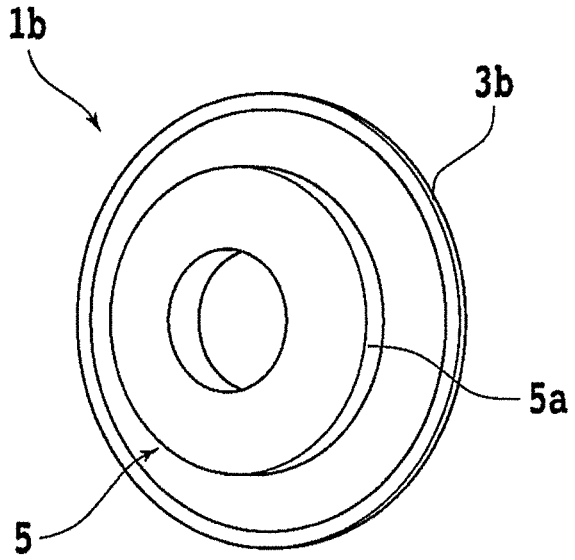
FIG. 1B is a perspective view schematically illustrating an annular grindstone including an annular base and a grindstone portion.

FIG. 1B is a perspective view schematically illustrating an annular grindstone including an annular base and a grindstone portion. An annular grindstone 1*b* illustrated in FIG. 1B is a grindstone, called a hub type, in which a grindstone portion 3*b* is disposed at an outer peripheral edge of an annular base 5. The annular base 5 has a grip portion 5*a* held by a user (operator) of the cutting apparatus when attaching/detaching the annular grindstone 1*b* to/from the cutting unit of the cutting apparatus. The grindstone portions 3*a* and 3*b* are formed, for example, by electrodepositing a binding material in which abrasive grains such as diamond abrasive grains are dispersed to a base composed of a metal such as aluminum. Note that the annular grindstones 1*a* and 1*b* formed by electrolytic plating or the like method are also referred to as electrodeposited grindstones or electroformed grindstones.

The grindstone portions 3*a* and 3*b* of the annular grindstones 1*a* and 1*b* each contain a binding material and abrasive grains which are dispersed in the binding material and fixed thereto. The abrasive grains which are moderately exposed from the binding material come in contact with the workpiece, whereby the workpiece is cut. When cutting of the workpiece proceeds, the abrasive grains fall off from the binding material. At this time, a blade edge is worn out, and as a result, fresh abrasive grains are exposed from the binding material one after another. This effect is referred to as self-sharpening, and this self-sharpening effect keeps cutting performance of each of the annular grindstones 1*a* and 1*b* at a constant level or more. In the annular grindstones 1*a* and 1*b* according to the present embodiment, the binding material contained in the grindstone portions 3*a* and 3*b* contains a nickel-iron alloy. A contained ratio of iron in the nickel-iron alloy (a weight ratio of iron based on the total weight of nickel and iron, for example) is a range of 5 wt % or more to less than 60 wt %, preferably 20 wt % or more to 50 wt % or less.

The workpiece is a substantially disc-shaped substrate or the like composed of a material such as silicon or silicon carbide (SiC), or other semiconductor materials, or a material composed of sapphire, glass, quartz, or the like. For example, a front surface of the workpiece is demarcated by a plurality of division lines arrayed in a grid pattern into a plurality of regions, and each of the regions thus demarcated has a device such as an integrated circuit (IC) or a light emitting diode (LED) formed therein. In the last step, the workpiece is divided along the division lines and formed into individual device chips.

Figure 2:
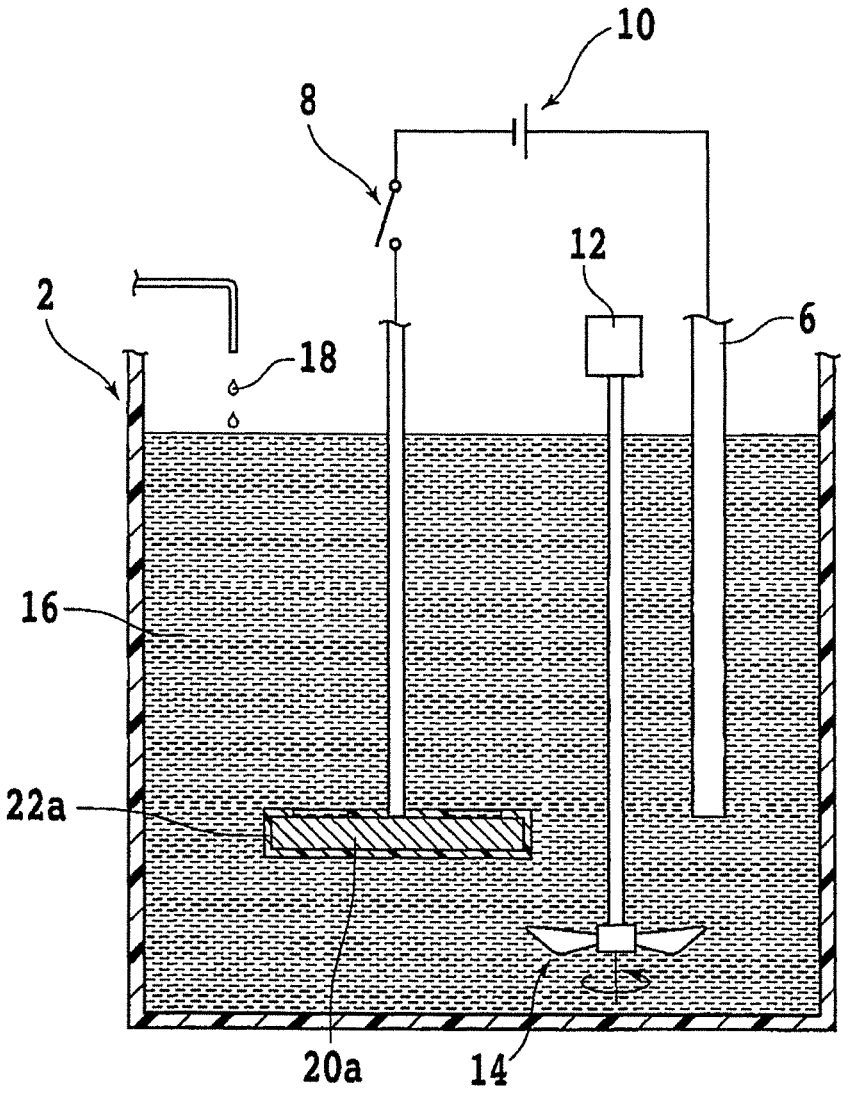
FIG. 2 is a cross-sectional view schematically illustrating a manufacturing process of the annular grindstone including the grindstone portion illustrated in FIG. 1A.

Next, a manufacturing method of the annular grindstone 1*a* of washer type illustrated in FIG. 1A will be described below. FIG. 2 is a cross-sectional view schematically illustrating a manufacturing process of the annular grindstone 1*a* including the grindstone portion 3*a* only. The annular grindstone 1*a* is formed by, for example, electrolytic plating or the like method. In the manufacturing method, first, an iron salt supplying ferrous ions is dissolved into a nickel plating solution 16 into which abrasive grains are mixed, and a plating bath 2 in which the nickel plating solution 16 is stored is prepared. The nickel plating solution 16 is an electrolytic solution containing nickel (nickel ion) such as nickel sulfate, nickel sulfamate, nickel chloride, nickel bromide, nickel acetate, or nickel citrate, and has abrasive grains such as diamond abrasive grains mixed therein. Note that a configuration of the nickel plating solution 16 and a contained ratio of each component are set appropriately such that a contained ratio of iron in the nickel-iron alloy contained in the binding material in the grindstone portion to be formed becomes a desired value. The iron salt supplying ferrous ions, or the like, is ferrous sulfate ($FeSO_4$), iron sulfamate ($Fe(NH_2SO_3)_2$), or the like, for example. A contained ratio of the iron salt in the nickel plating solution 16 is suitably adjusted, so that the contained ratio of iron in the nickel-iron alloy contained in the binding material can be set to a desired value.

After preparation of the plating bath 2 is completed, a base 20*a* on which the grindstone portion 3*a* is formed through electrodeposition, and a nickel electrode 6 are immersed into the nickel plating solution 16 in the plating bath 2. The base 20*a* is, for example, formed of a metal material such as stainless steel or aluminum in a disc-like shape, and on a front surface thereof, a mask 22*a* corresponding to a desired shape of the grindstone portion 3*a* is formed. Note that the mask 22*a* which achieves a circular ring-shaped grindstone 1*a* is formed in the present embodiment. The base 20*a* is connected to a minus terminal (negative electrode) of a direct-current power source 10 through a switch 8. Meanwhile, the nickel electrode 6 is connected to a plus terminal (positive electrode) of the direct-current power source 10. Note that the switch 8 may be disposed between the nickel electrode 6 and the direct-current power source 10.

Figure 3A:
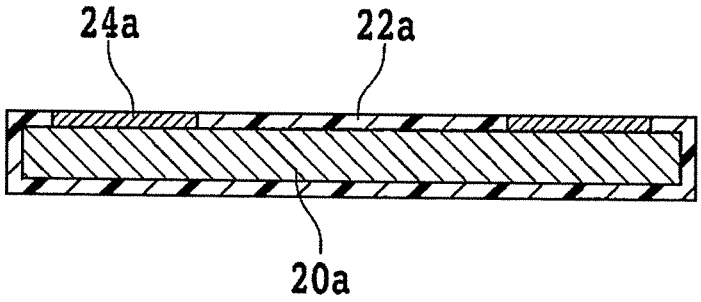
FIG. 3A is a cross-sectional view schematically illustrating the grindstone portion formed in the manufacturing process illustrated in FIG. 2.
Figure 3B:
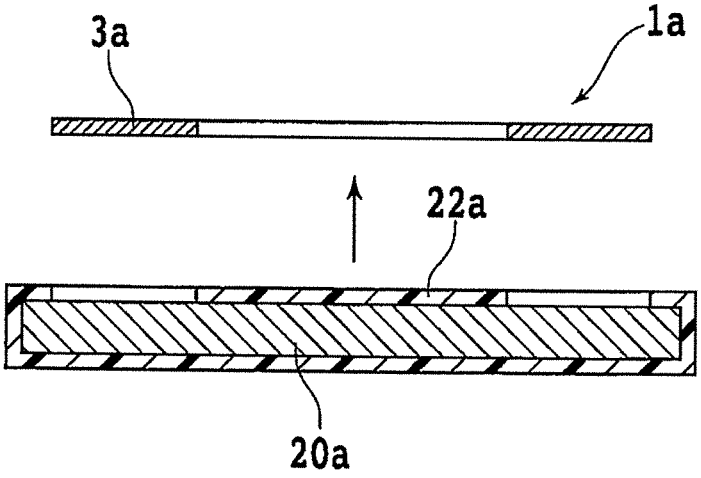
FIG. 3B is a cross-sectional view schematically illustrating removal of a base, continued from FIG. 3A.

After the immersion is carried out, by causing a direct current to flow through the nickel plating solution 16 with the base 20*a* as a cathode and the nickel electrode 6 as an anode, abrasive grains and a plating layer are deposited on a portion of the front surface of the base 20*a* which is not covered with the mask 22*a*. As illustrated in FIG. 2, while a fan 14 is rotated by a rotation driving source 12 such as a motor to stir the nickel plating solution 16, the switch 8 disposed between the base 20*a* and the direct-current power source 10 is short-circuited. FIG. 3A is a cross-sectional view schematically illustrating a plating layer 24*a* thus formed. When the plating layer 24*a* becomes a desired thickness, the switch 8 is disconnected to stop deposition of the plating layer. Next, the whole base 20*a* is removed, and the plating layer 24*a* is separated from the base 20*a*. FIG. 3B is a cross-sectional view schematically illustrating removal of the base 20*a*. Accordingly, the grindstone portion 3*a* in which the plating layer 24*a* containing nickel has the abrasive grains substantially equally dispersed therein can be formed, and the annular grindstone 1*a* of washer type is achieved.

Figure 4:
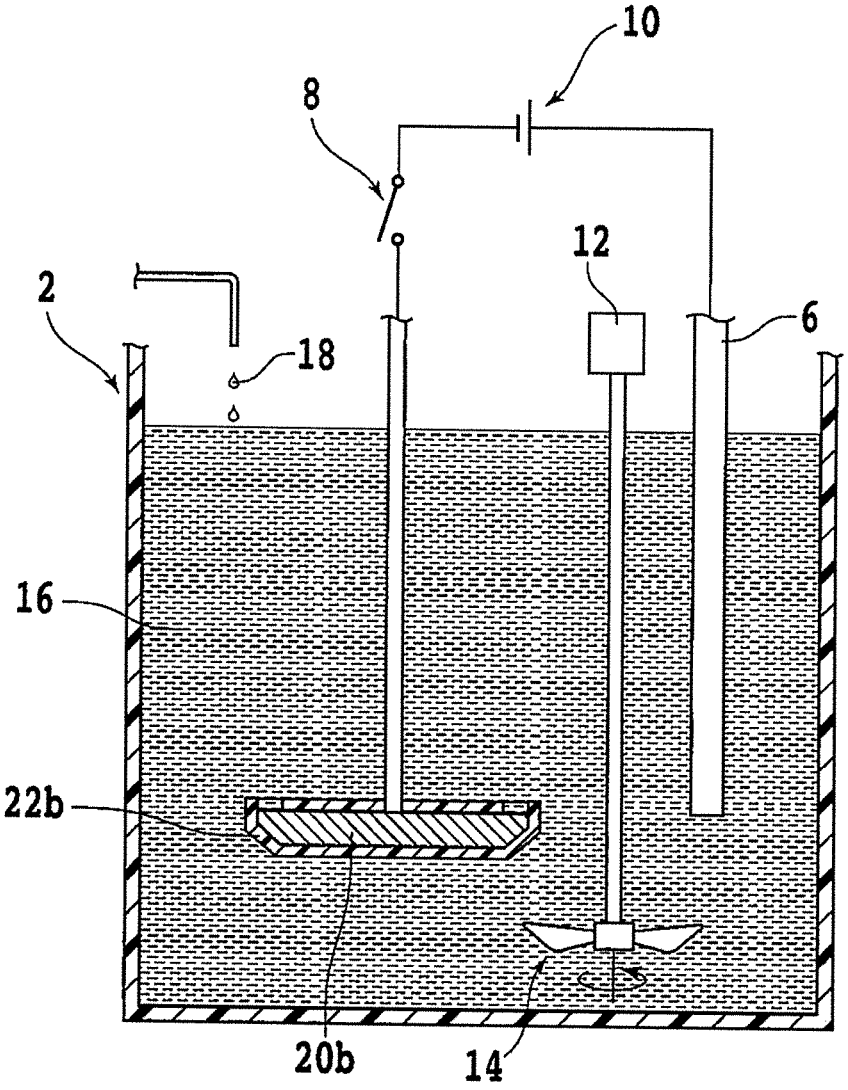
FIG. 4 is a cross-sectional view schematically illustrating a manufacturing process of the annular grindstone including the grindstone portion and the annular base illustrated in FIG. 1B.

A manufacturing method of the annular grindstone 1*b* of hub type illustrated in FIG. 1B will be next described below. FIG. 4 is a cross-sectional view schematically illustrating a manufacturing process of the annular grindstone 1*b* including the grindstone portion 3*b* and the annular base 5 illustrated in FIG. 1B. Similarly to the annular grindstone 1*a*, the annular grindstone 1*b* is formed by electrolytic plating or the like methods in the plating bath 2, for example. In the manufacturing method, a plating bath similarly to the manufacturing method of the annular grindstone 1*a* is prepared. Since a configuration of the plating bath 2, the nickel plating solution 16, and the additive 18 is similar to one in the above-described manufacturing method of the annular grindstone 1*a*, description thereof will be omitted here. However, part of the base 20*b* connected to the negative electrode of the direct-current power source 10 becomes the annular base 5 supporting the grindstone portion 3*b* of the annular grindstone 1*b*, a shape of the base 20*b* is assumed to be a shape corresponding to the annular base 5. In addition, on a front surface of the base 20*b*, a mask 22*b* in a shape corresponding to a shape of the grindstone portion 3*b* is formed. Then, in the similar manner to the manufacturing method of the annular grindstone 1*a* described above, the plating layer is deposited on an exposed part of the base 20*b*.

Figure 5A:
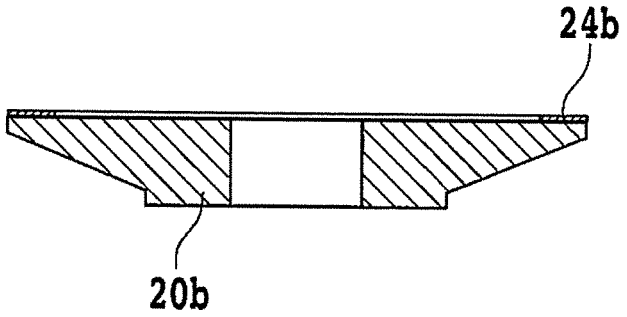
FIG. 5A is a cross-sectional view schematically illustrating the grindstone portion formed in the manufacturing process illustrated in FIG. 4.
Figure 5B:
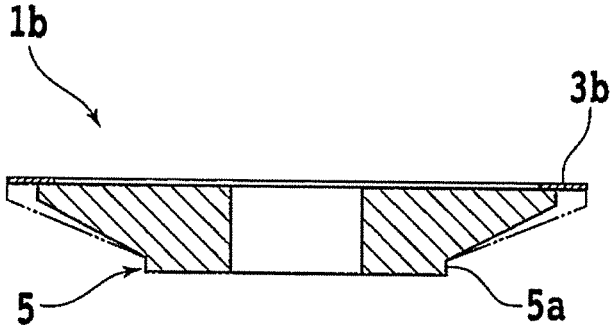
FIG. 5B is a cross-sectional view schematically illustrating partial removal of a base, continued from FIG. 5A.

FIG. 5A is a cross-sectional view schematically illustrating the grindstone portion formed in the manufacturing process illustrated in FIG. 4. FIG. 5B is a cross-sectional view schematically illustrating partial removal of the base, continued from FIG. 5A. Part of the base 20*b* is removed to expose part of a region of the plating layer 24*b* which is covered with the base 20*b*. Note that, as illustrated in FIG. 5A, the mask 22*b* is removed from the base 20*b* in advance before the base removing step is carried out. Then, as illustrated in FIG. 5B, an outer peripheral region of the base 20*b* on a side where the plating layer 24*b* becoming the grindstone portion 3*b* is not formed is partially etched to thereby expose the part of the grindstone portion 3*b* which is covered with the base 20*b*. Accordingly, the annular grindstone 1*b* of hub type in which the grindstone portion 3*b* is fixed to an outer peripheral region of the annular base 5 is achieved.

Herein, a relation between a contained ratio (wt %) of iron in the nickel-iron alloy contained in the binding material in the annular grindstone and a corrosion rate of the grindstone portion of the annular grindstone will be described. In the present embodiment, a plurality of annular grindstones different in contained ratio of iron in the nickel-iron alloy contained in the binding material from one another were fabricated, and an experiment on corrosion of the grindstone was conducted, thereby indicating a result of studying the relation between the contained ratio of iron and the corrosion rate. In the experiment, fabricated were the annular grindstones having a contained ratio of iron in the nickel-iron alloy of 0 wt % (comparison example), 5 wt %, 10 wt %, 20 wt %, 30 wt %, 50 wt %, and 60 wt %. Assuming a cutting step in which the annular grindstone was used, each of the annular grindstones fabricated above was mounted on a cutting unit of a cutting apparatus, and the annular grindstone was rotated at 30,000 rpm while a cutting water containing carbon dioxide had continued to be supplied to the annular grindstone for 72 hours.

Note that, in this experiment, two kinds of cutting water with different concentrations of carbon dioxide, cutting water having a specific resistance value of 0.1 MΩ·cm and cutting water having a specific resistance value of 0.2 MΩ·cm, were prepared to be each supplied to the annular grindstone. Then, a weight of each of the annular grindstones was measured before the two kinds of cutting water were supplied and after the two kinds of cutting water had been supplied for 72 hours, to thereby obtain a reduced amount of the weight of each of the annular grindstones. Then, when a reduced amount of the weight of the annular grindstone having a contained ratio of iron in the nickel-iron alloy of 0 wt % was set to 100%, a ratio of the reduced amount of each of the annular grindstones was calculated as a corrosion rate (%).

Note that, in this experiment, in order to exclude a change in weight of components other than the grindstone portion of the annular grindstone from the result of this experiment, cutting water containing carbon dioxide had been supplied to the annular base of the annular grindstone for 72 hours in advance, and a weight of each of the annular grindstones before the experiment and a weight of each of the annular grindstones after the experiment were measured. More specifically, first, a weight of each of the annular grindstones before and after the experiment was measured to calculate a change amount in weight of each of the annular grindstones, and a change amount in weight of each of the grindstone portions was obtained by subtracting a change amount in weight of the annular base from the change amount in weight of each of the annular grindstones. Then, the change amount in weight of each of the grindstone portions was divided by the change amount in weight of the grindstone portion according to the comparison example in which the contained amount of iron was 0 wt %, to thereby calculate a corrosion rate (%). For example, in a case in which the corrosion rate is 100%, it means that the grindstone portion in this case corrodes similarly to the grindstone portion according to the comparison example. In contrast, in a case in which the corrosion rate is 0%, there is confirmed no change amount in weight of the grindstone portion, and it means that the grindstone portion in this case does not corrode.

Figure 6:
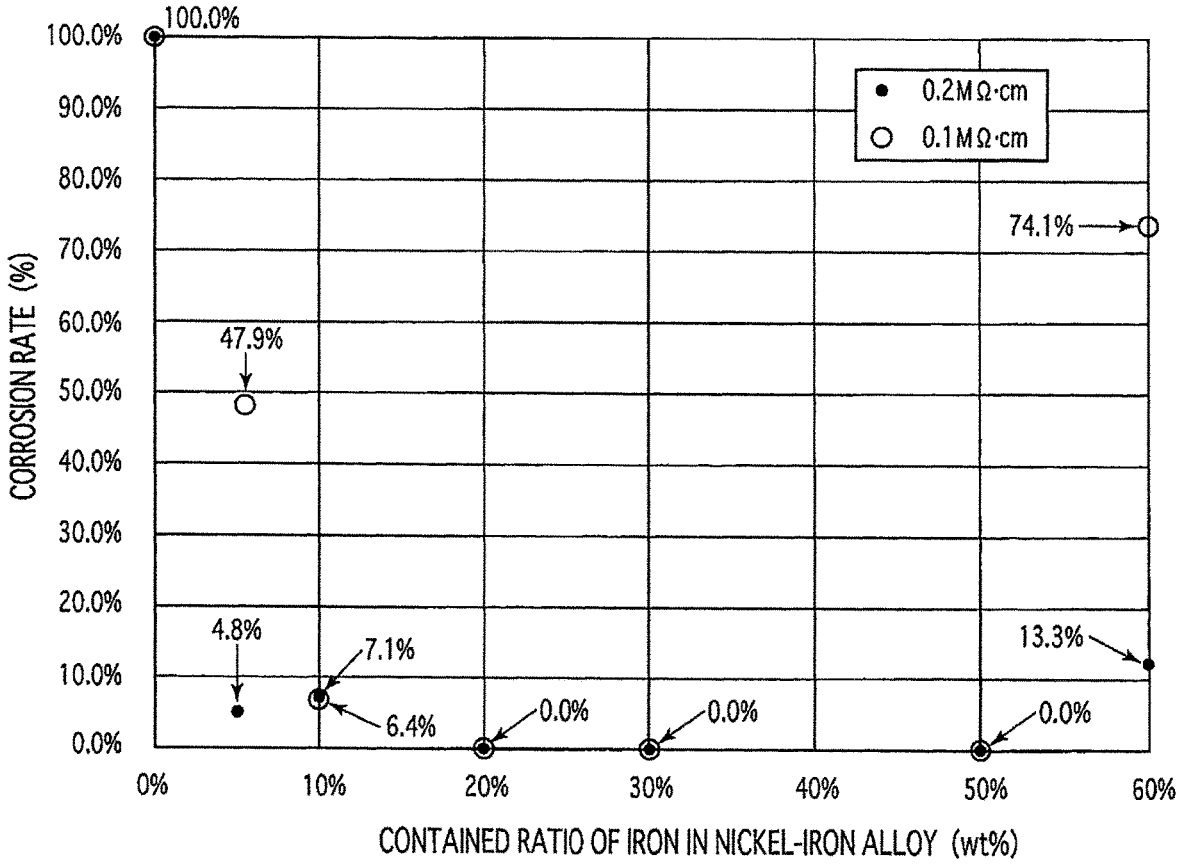
FIG. 6 is a chart explaining a relation between a contained ratio of iron in a nickel-iron alloy and a corrosion rate.

The result of the experiment will be studied below. As illustrated in FIG. 6, when the cutting water having a specific resistance value of 0.2 MΩ·cm was supplied, the corrosion rate of the grindstone portion having the contained ratio of iron in the nickel-iron alloy contained in the binding material of 5 wt % was 4.8%. Similarly, the corrosion rate of the grindstone portion having the contained ratio of iron in the nickel-iron alloy contained in the binding material of 10 wt % was 7.1%. In the grindstone portions each having the contained ratio of iron in the nickel-iron alloy contained in the binding material of 20 wt %, 30 wt %, and 50 wt %, no change in weight of each of the grindstone portions before and after the experiment was confirmed, and the corrosion rate was 0.0%. Further, the corrosion rate of the grindstone portion having the contained ratio of iron in the nickel-iron alloy contained in the binding material of 60 wt % was 13.3%. Also, as illustrated in FIG. 6, when the cutting water with the specific resistance value of 0.1 MΩ·cm and having higher corrosion effect is supplied, the corrosion rate of the grindstone portion having the contained ratio of iron in the nickel-iron alloy contained in the binding material of 5 wt % was 47.9%. Similarly, the corrosion rate of the grindstone portion having the contained ratio of iron in the nickel-iron alloy contained in the binding material of 10 wt % was 6.4%. In the grindstone portions each having the contained ratio of iron in the nickel-iron alloy contained in the binding material of 20 wt %, 30 wt %, and 50 wt %, no change in weight of each of the grindstone portions before and after the experiment was confirmed, and the corrosion rate was 0.0%. Further, the corrosion rate of the grindstone portion having the contained ratio of iron in the nickel-iron alloy contained in the binding material of 60 wt % was 74.1%.

According to the result of the experiment described above, it was confirmed that the grindstone portion having the contained ratio of iron in the nickel-iron alloy contained in the binding material of 5 wt % or more was significantly prevented from being corroded, compared to the grindstone portion containing no iron in the binding material. Particularly, in a case in which the contained ratio of iron in the nickel-iron alloy contained in the binding material was increased to be 20 wt % or more and 50 wt % or less, it was confirmed that the grindstone portion was not corroded. In addition, when the contained ratio of iron in the nickel-iron alloy contained in the binding material reached 60 wt %, it was confirmed that the grindstone portion was corroded. This can be considered that, since the ratio of iron in the nickel-iron alloy became too high, rust was formed on the iron in the grindstone portion, making the grindstone portions brittle. According to the experiment described above, it can be said that the contained ratio of iron in the nickel-iron alloy contained in the binding material is preferably in a range of 5 wt % or more to less than 60 wt %, more preferably 20 wt % or more to 50 wt % or less.

As described above, according to this embodiment, even when the cutting water in which carbon dioxide is mixed is supplied, it is possible to provide the annular grindstone in which corrosion of the binding material is less likely to occur. Accordingly, a change in performance of the annular grindstone in performing cutting processing is reduced, and excessive consumption of the annular grindstone is suppressed, so that a frequency of replacement of the annular grindstone can be decreased. In the foregoing embodiment, a case in which the grindstone portion is formed by depositing the plating layer containing the nickel-iron alloy through electrolytic plating has been described; however, the annular grindstone according to an aspect of the present invention is not limited thereto. The annular grindstone according to the aspect of the present invention may be formed by other methods. For example, the grindstone portion may be formed by punching out a sheet composed of a nickel-iron alloy containing abrasive grains with a die of a predetermined shape.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. an annular grindstone comprising: a grindstone portion including a binding material, and abrasive grains which are dispersed into the binding material to be fixed by electrodeposition to the grindstone, wherein the binding material contains a nickel-iron alloy;

wherein a contained ratio of iron in the nickel-iron alloy is in a range of 20 wt % or more to 50 wt % or less.

2. The annular grindstone according to claim 1, wherein the annular grindstone comprises the grindstone portion only.

3. The annular grindstone according to claim 1, further comprising:

an annular base including a grip portion, wherein the grindstone portion is exposed at an outer peripheral edge of the annular base.

4. The annular grindstone according to claim 1, wherein the corrosion rate of the grindstone portion is 0% when cutting water comprising carbon dioxide is supplied to the grindstone.

5. A process for cutting a semiconductor wafer using an annular grindstone and cutting water, the grindstone comprising:

a grindstone portion including a binding material, and abrasive grains which are dispersed into the binding material to be fixed by electrodeposition to the grindstone, wherein the binding material contains a nickel-iron alloy;

wherein a contained ratio of iron in the nickel-iron alloy is in a range of 20 wt % or more to 50 wt % or less;

the process comprising:

bringing the grindstone into contact with the semiconductor wafer; supplying the cutter water to the grindstone, wherein the cutter water comprises carbon dioxide.

6. The process of claim 5 wherein the cutting water has a specific resistance value of 0.1 MΩ·cm.

7. The process of claim 5 wherein the cutting water has a specific resistance value of 0.2 MΩ·cm.

8. The process of claim 5, wherein the corrosion rate of the grindstone portion is 0% in response to the supplying the cutting water comprising carbon dioxide to the grindstone.

* * * * *